US012478128B2

(12) United States Patent
Dulude et al.

(10) Patent No.: US 12,478,128 B2
(45) **Date of Patent: *Nov. 25, 2025**

(54) WATERPROOF BOOT WITH INTERNAL CONVECTION SYSTEM

(71) Applicant: TBL Licensing LLC, Stratham, NH (US)

(72) Inventors: Ryan Dulude, Lee, NH (US); Brian Lee Strother, Dover, NH (US); James McLain, Somersworth, NH (US); Stephen Douglas Ammon, Hampton, NH (US); Thomas Yeh, Broomfield, CO (US); Emily V. Miller, Eliot, ME (US)

(73) Assignee: TBL Licensing LLC, Stratham, NH (US)

( * ) Notice: Subject to any disclaimer, the term of this patent is extended or adjusted under 35 U.S.C. 154(b) by 37 days.

This patent is subject to a terminal disclaimer.

(21) Appl. No.: 17/715,469

(22) Filed: Apr. 7, 2022

(65) Prior Publication Data

US 2022/0225725 A1 Jul. 21, 2022

Related U.S. Application Data

(62) Division of application No. 16/429,617, filed on Jun. 3, 2019, now Pat. No. 11,297,893.

(Continued)

(51) Int. Cl.
*A43B 7/08* (2022.01)
*A43B 13/14* (2006.01)

(Continued)

(52) U.S. Cl.
CPC ..... *A43B 7/081* (2013.01); *A43B 13/14* (2013.01); *A43B 13/38* (2013.01); *A43B 17/08* (2013.01); *A43B 17/14* (2013.01)

(58) Field of Classification Search
CPC ..... A43B 7/08; A43B 7/081; A43B 7/082; A43B 7/085; A43B 7/105; A43B 17/035; A43B 17/08

(Continued)

(56) References Cited

U.S. PATENT DOCUMENTS 1,329,559 A * 2/1920 Tesla ..... F15D 1/02 137/842
2,010,151 A * 8/1935 Arthur ..... A43B 7/06 36/147

(Continued)

FOREIGN PATENT DOCUMENTS

CN 101668446 A 3/2010
CN 103300536 A 9/2013

(Continued)

OTHER PUBLICATIONS

Partial European Search including Written Opinion Report for Application No. EP19178226.7 dated Oct. 18, 2019.

(Continued)

*Primary Examiner* — Sharon M Prange
(74) *Attorney, Agent, or Firm* — Lerner David LLP

(57) ABSTRACT

Disclosed is a waterproof shoe with an improved ventilation mechanism, designed to circulate air from the outside environment through the shoe in order to provide convective cooling to a wearer's foot. In a desired embodiment, the shoe may incorporate a pump-ventilation mechanism which, coupled with airflow channels incorporated in the upper, acts to establish continuous substantially one-way airflow through the shoe in a heel-to-toe direction while a user walks.

12 Claims, 12 Drawing Sheets

Related U.S. Application Data

(60) Provisional application No. 62/680,231, filed on Jun. 4, 2018.

(51) Int. Cl.
*A43B 13/38* (2006.01)
*A43B 17/08* (2006.01)
*A43B 17/14* (2006.01)

(58) Field of Classification Search
USPC ..... 36/3 B
See application file for complete search history.

(56) References Cited

U.S. PATENT DOCUMENTS

| | | | | |
|---|---|---|---|---|
| 4,000,566 | A | 1/1977 | Famolare, Jr. | |
| 5,375,345 | A | 12/1994 | Djuric | |
| 5,477,626 | A * | 12/1995 | Kwon | A43B 7/082 36/3 R |
| 5,505,010 | A | 4/1996 | Fukuoka | |
| 6,370,799 | B1 | 4/2002 | Thatcher | |
| 6,581,303 | B1 | 6/2003 | Tuan | |
| 6,745,499 | B2 | 6/2004 | Christensen et al. | |
| 7,493,706 | B2 | 2/2009 | Cho et al. | |
| 7,578,074 | B2 | 8/2009 | Ridinger | |
| 8,074,374 | B2 | 12/2011 | Chang | |
| 8,291,976 | B2 * | 10/2012 | Schultz | E21B 43/12 166/334.4 |
| 8,850,717 | B2 * | 10/2014 | Lin | A43B 7/08 36/3 R |
| 8,919,011 | B2 * | 12/2014 | Byrne | A43B 7/081 36/3 R |
| 9,107,468 | B1 | 8/2015 | Xiong | |
| 10,010,132 | B2 | 7/2018 | Litvinov | |
| 10,354,763 | B2 * | 7/2019 | Loewen | F16K 15/00 |
| 10,477,914 | B2 | 11/2019 | Mohlmann et al. | |
| 2003/0217484 | A1 | 11/2003 | Christensen et al. | |
| 2005/0005473 | A1 * | 1/2005 | Oh | A43B 7/081 36/3 R |
| 2006/0156575 | A1 * | 7/2006 | Lo | A43B 17/08 36/29 |
| 2007/0011908 | A1 | 1/2007 | Huang et al. | |
| 2007/0094890 | A1 * | 5/2007 | Cho | A43B 13/203 36/3 B |
| 2008/0229623 | A1 * | 9/2008 | Ferretti | A43B 7/082 36/3 R |
| 2009/0151203 | A1 | 6/2009 | Boyer et al. | |
| 2010/0132228 | A1 | 6/2010 | Polegato Moretti | |
| 2010/0223817 | A1 * | 9/2010 | Chang | A43B 7/082 36/43 |
| 2011/0061269 | A1 | 3/2011 | Nakano | |
| 2011/0283566 | A1 | 11/2011 | Chou | |
| 2014/0151062 | A1 * | 6/2014 | Stephenson | E21B 43/12 166/162 |
| 2014/0259750 | A1 * | 9/2014 | Yeh | A43B 13/20 36/29 |
| 2015/0059718 | A1 * | 3/2015 | Claywell | F01M 13/04 123/572 |
| 2015/0075036 | A1 * | 3/2015 | Davis | A43B 7/087 36/25 R |
| 2015/0201700 | A1 | 7/2015 | Jang et al. | |
| 2016/0029740 | A1 * | 2/2016 | Möhlmann | A43B 13/203 36/3 B |
| 2018/0020768 | A1 * | 1/2018 | Litvinov | A43B 3/38 36/3 R |

FOREIGN PATENT DOCUMENTS

| | | | |
|---|---|---|---|
| CN | 207411577 | U | 5/2018 |
| EP | 2636325 | A1 | 9/2013 |
| EP | 3202275 | A1 | 8/2017 |
| WO | 2008125524 | A1 | 10/2008 |

OTHER PUBLICATIONS

Clarks Active Air Vent, 10 Steps To Total Refreshment, <https://www.clarksusa.com/us/about-clarks/active-air-vent>, dated Nov. 2017.
European Search Report including the Written Opinion for Application No. 19178226.7 dated Mar. 6, 2020, 8 pages.
Chinese Search Report for Application No. 201910481586.0 dated Dec. 28, 2020, 3 pages.
Chinese Search Report for Application No. 201910481586.0, dated Aug. 18, 2021, 2 pages.

* cited by examiner

WATERPROOF BOOT WITH INTERNAL CONVECTION SYSTEM

CROSS-REFERENCE TO RELATED APPLICATION

This application is a divisional of U.S. application Ser. No. 16/429,617, filed Jun. 3, 2019, which claims the benefit of the filing date of U.S. Provisional Application No. 62/680,231 filed Jun. 4, 2018, the disclosures of which are hereby incorporated herein by reference.

BACKGROUND OF THE INVENTION

The present technology relates in general to waterproof footwear that incorporates an improved pump-ventilation mechanism. Waterproof footwear is generally constructed with an upper that is substantially impermeable to water and which, in many instances, extends up over the ankle or even higher on the leg. Such footwear is useful for many applications, particularly in outdoor work and sporting activities such as construction, fishing, hiking, hunting and the like. While such waterproof footwear may protect a wearer's foot from water, the waterproof material of the upper is also likely to prevent airflow through the walls of the upper. Because the upper may extend over the ankle and higher, airflow over a significant portion of the wearer's foot and leg may be blocked. This inhibits convective cooling of the wearer's foot and lower extremities, resulting in footwear that becomes hot, sweaty, and uncomfortable during use, particularly when the wearer is continuously walking or otherwise active. As waterproof footwear is often used during strenuous outdoor activity, this lack of ventilation may pose a significant problem.

BRIEF SUMMARY OF THE INVENTION

Accordingly, aspects of the present technology provide a substantially waterproof shoe having a ventilation mechanism which coordinates with specially designed airflow channels in the upper to circulate air from the outside environment through the shoe in order to provide convective cooling of a wearer's foot during movement.

DETAILED DESCRIPTION

Aspects of the present technology provide a waterproof shoe with an improved ventilation mechanism, designed to circulate air from the outside environment through the shoe in order to provide convective cooling to a wearer's foot. In a desired embodiment, the shoe may incorporate a pump-ventilation mechanism which, coupled with airflow channels incorporated in the upper, acts to establish continuous substantially one-way airflow through the shoe in a heel to toe direction while a user walks.

Figure 1:
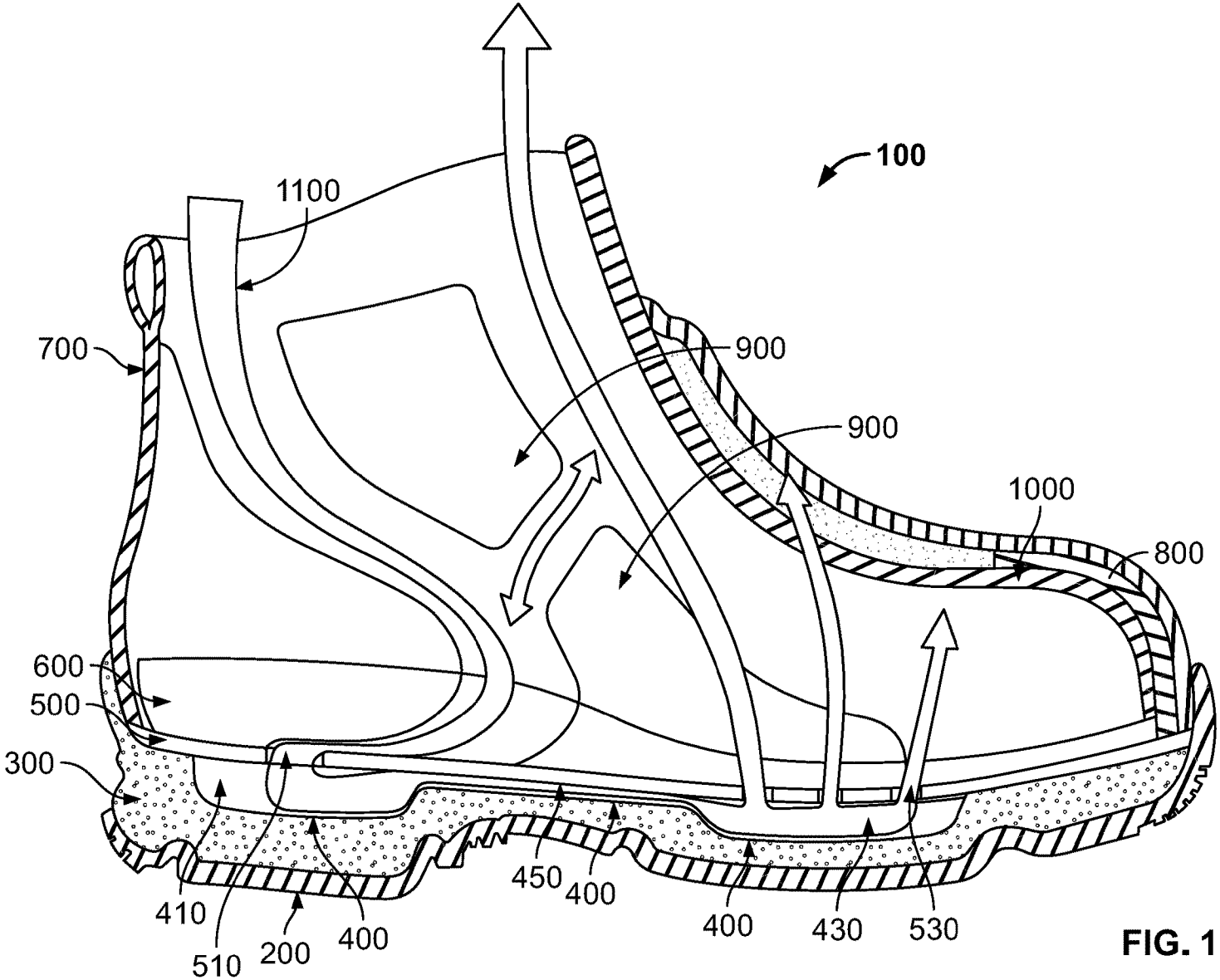
FIG. 1 is a longitudinal cross-sectional view of a shoe in accordance with aspects of the present technology.

As shown in FIG. 1, an exemplary shoe 100 includes: an outsole 200, a midsole 300, a ventilation mechanism 400, a baseboard 500, an insole 600, an upper 700, a protective toe cap 800, ankle pads 900, a lining 1000, and airflow channels 1100.

The outsole 200 has a bottom surface configured to contact the ground and a top surface configured to be secured to the midsole 300. The midsole 300 has a bottom surface configured to be secured to the outsole 200 and a top surface configured to be secured to the upper 700. In some aspects, the midsole 300 may include an embedded shank which has a top surface which is generally flush with the top surface of the midsole 300 and a bottom surface which may extend into the top surface of midsole 300.

In a preferred embodiment, the ventilation mechanism 400 may be a separate component from the midsole 300 or baseboard 500. In such an embodiment, the ventilation mechanism 400 may be disposed within a cavity in the top surface of the midsole 300 and has a top surface which sits flush with the top surface of the midsole 300 and a bottom surface which extends into the cavity. The ventilation mechanism 400 generally comprises three components: an intake reservoir 410, an exhaust reservoir 430, and a connecting channel 450. The intake reservoir may be disposed in a heel region of the midsole 300 and the exhaust reservoir may be disposed in a toe region of the midsole 300 with the connecting channel running between them, so that they are placed in fluid communication with one another. In alternative embodiments, the ventilation mechanism 400 may be formed integrally within the midsole 300, baseboard 500, or, optionally, a removable insert 470 of the shoe. In some embodiments, the exhaust reservoir may be disposed elsewhere than in the toe region, for example in the heel, in the lining, or in the upper.

The baseboard 500 may be a substantially planar member having a bottom surface configured to contact the top surfaces of both the midsole 300 and, in some embodiments, the ventilation mechanism 400 and a top surface configured to contact the insole 600. The baseboard 500 may be permanently secured to the midsole 300 by an adhesive.

The insole 600 may be a flexible insert which has a bottom surface configured to contact the baseboard 500 and a top surface configured to receive the foot of a wearer. In some aspects, the insole 600 may be removable from the shoe 100.

The upper 700 may be substantially waterproof and extends upwards from the midsole 300 to form a cavity configured to receive a user's foot. The upper 700 has an inner surface which may be configured to receive a wearer's foot and promote air flow within the shoe 100 and an outer surface which may be configured to repel water and otherwise interact with the outside environment. In some embodiments, the upper 700 may additionally include a tongue portion having a ventilation channel running in a longitudinal direction.

The protective toe cap 800 may comprise a hemi-dome shaped body sized and shaped to cover a wearer's toes, so as to protect them from impact with obstacles, falling objects, and the like. The protective toe cap 800 may have an outer surface configured to be permanently secured to the inner surface of the upper 700 and an inner surface configured to receive and protect a wearer's toes. The protective toe cap may further comprise a ventilation channel extending in a longitudinal direction between a forefoot area and a midfoot area of the shoe.

The ankle pads 900 may comprise raised polygonal pads which may be permanently affixed to the inner surface of the upper on opposing lateral sides in ankle regions of the upper of the shoe.

The lining 1000 may be a porous fabric lining which may be disposed on the inner surface of the upper 700, overtop of the protective toe cap 800 and the ankle pads 900, such that it covers both of these elements as well as the entire inner surface of the upper 700. The lining 1000 may be permanently secured in position by stitching to the upper 700.

The ankle pads 900, lining 1000, and the upper 700 may be positioned to define airflow channels which are held away from close contact with the foot and ankle of a wearer so as to allow intake and exhaust of air from and to the outside environment in cooperation with the ventilation channel of the protective toe cap 800.

Outsole

Figure 2A:
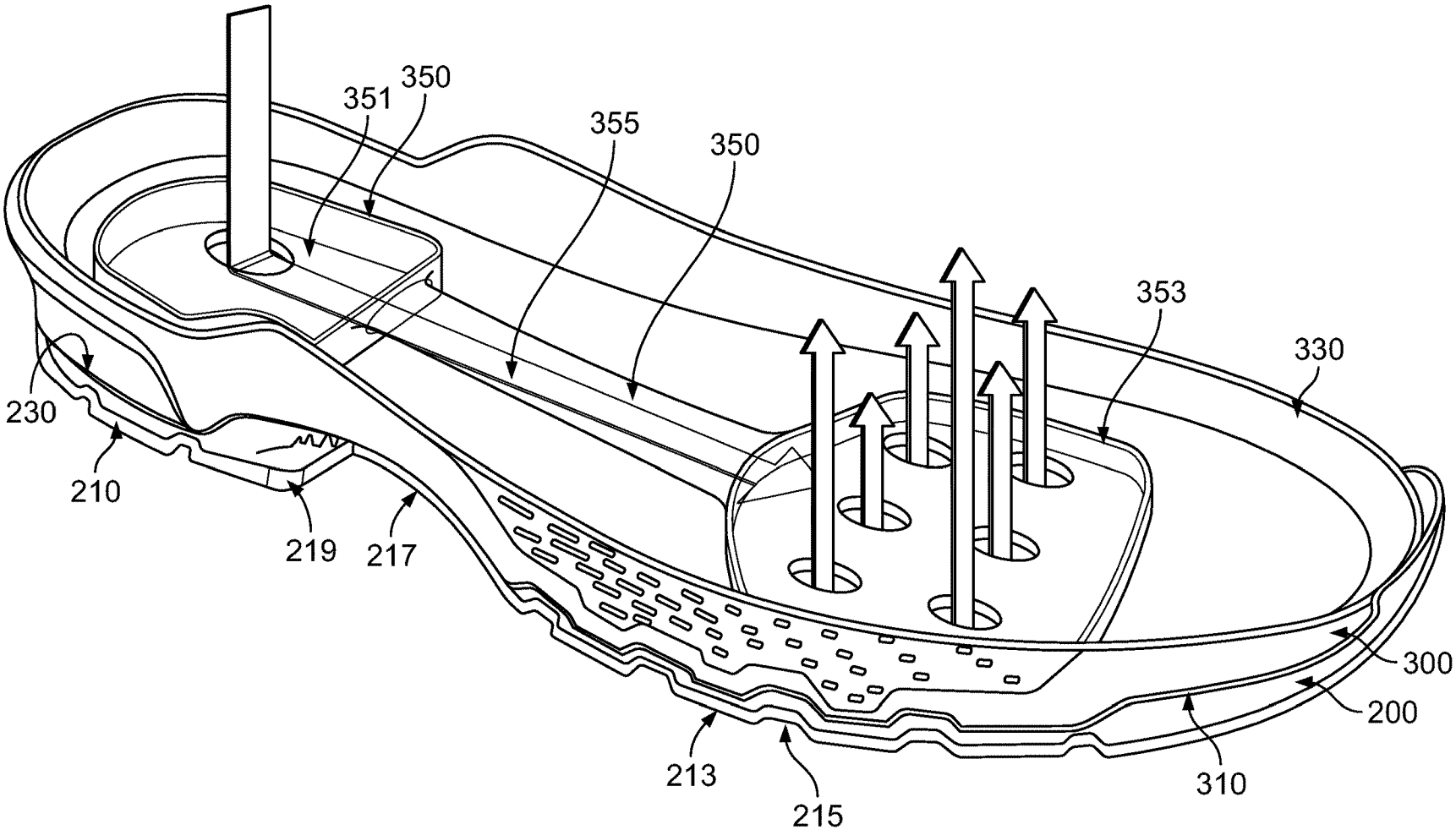
FIG. 2A is a top-down view of an outsole and midsole in accordance with aspects of the present technology.
Figure 2B:
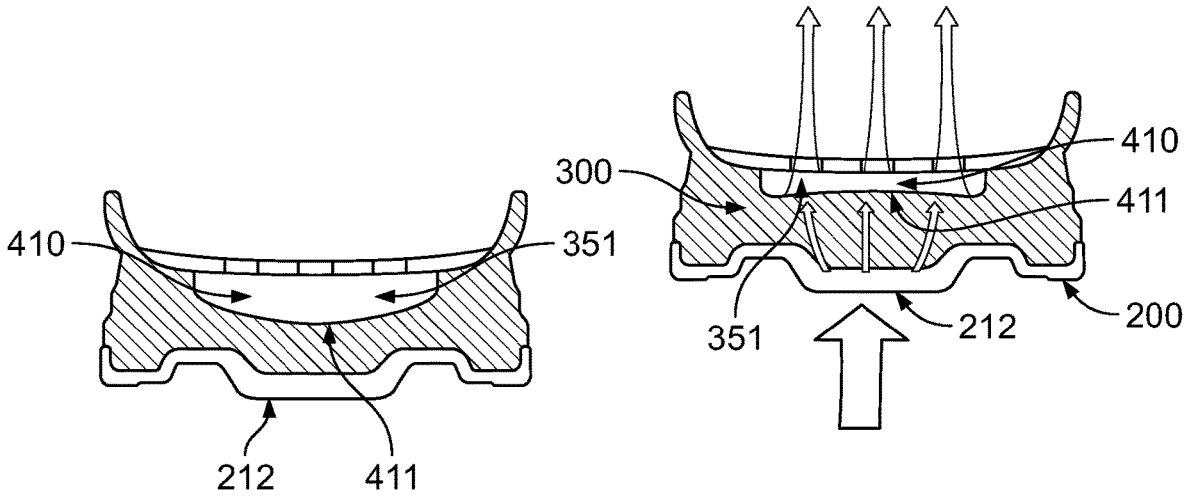
FIG. 2B is a lateral cross-sectional view of toe and heel portions of an outsole and midsole in accordance with aspects of the present technology.
Figure 2C:
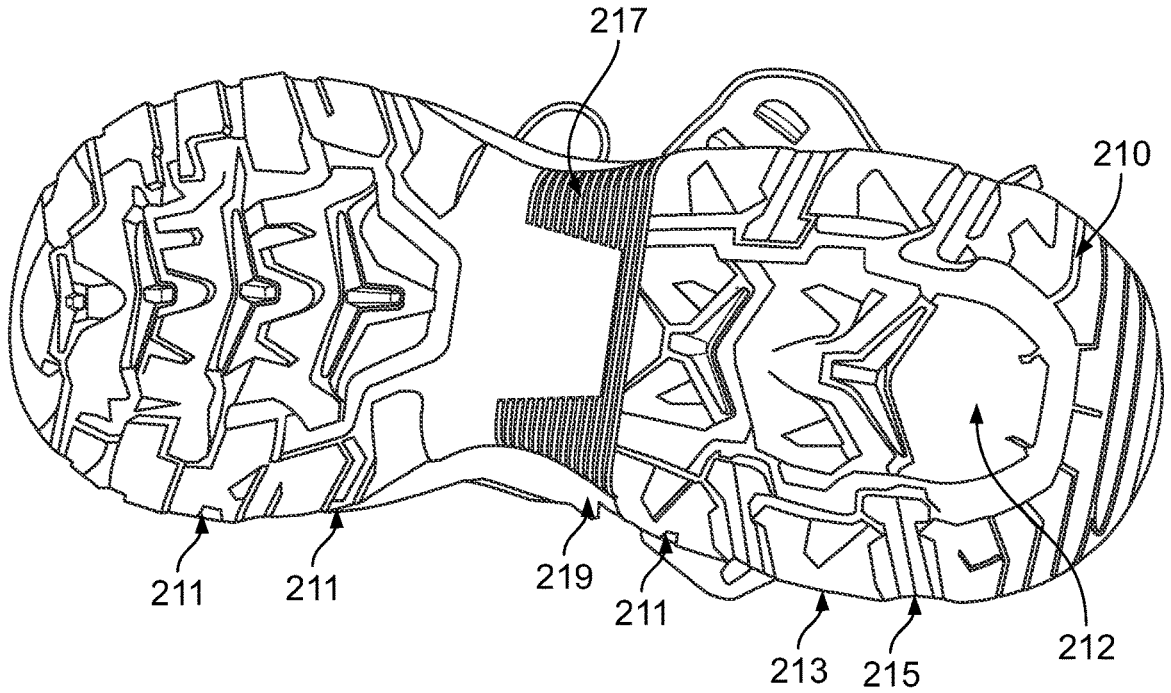
FIG. 2C is a view of the bottom surface of an outsole in accordance with aspects of the present technology.

As depicted in FIGS. 2A-C, the outsole 200 has a bottom surface 210 configured to contact the ground and a top surface 230 configured to be secured to the midsole 300.

As shown particularly in FIGS. 2A and 2C, the bottom surface 210 of the outsole may have a tread pattern 211 which is configured to prevent slipping on wet, oily, uneven, or irregular surfaces. Such a tread pattern may include raised ridges or lugs 213 of a generally polygonal shape such as diamonds, triangles, rectangles, squares, and the like. The tread pattern may include deeply cut channels 215 in between the raised portions in order to provide increased friction and grip of wet surfaces in particular. In addition, the bottom surface of the outsole may include a concave section 217 in a midfoot portion of the outsole 200 configured to correspond with the arch of the foot. This concave section may include a series of lateral ridges, designed to increase friction and grip. In some embodiments, a heel portion of the bottom surface of the outsole may jut out sharply from this concave section to create a lip 219. Lip 219, along with the ridged pattern of the concave section 217 may be configured to allow a wearer to securely stand, grip, and/or move on narrow surfaces such as a ladder or the edge of a shovel.

In some aspects, as shown in FIGS. 2B-C, the bottom surface 210 of the outsole may further comprise a raised platform 212 in a heel region which protrudes beyond the adjacent areas of the bottom surface 210 of the outsole. The raised platform 212 may be configured to contact the ground first as a wearer begins a stride and then to flex upwards in the direction of the wearer's foot, so that the adjacent surfaces of the outsole may contact the ground as the wearer's weight is applied to the heel. In some aspects, the raised platform may be positioned in a region of the outsole which lies directly adjacent and beneath the intake reservoir 410. In such a configuration, when the raised platform 212 flexes upwards, it may provide pressure on the bottom surface 411 of the intake reservoir 410, causing it to compress.

The outsole 200 may be comprise an elastomer, including a thermoplastic polyurethane (TPU), a rubber, a polyurethane (PU), an ethyl vinyl acetate (EVA), or any combinations thereof. Such materials are beneficial in that they are oil and slip resistant and also do not tend to mark or stain other surfaces such as flooring and cement.

Midsole

As depicted in FIGS. 2A-B, the midsole 300 has a bottom surface 310 configured to be secured to the outsole 200 and a top surface 330 configured to be secured to the upper 700 along the edges. The bottom surface 310 of midsole 300 may be permanently secured to the outsole 700 by an adhesive or, alternatively, by stitching, welting, or direct attachment such as injection molding.

In a preferred embodiment shown in FIGS. 2A-B, the top surface 330 of midsole 300 may include a specially formed cavity 350, designed to receive the ventilation mechanism 400. Cavity 350 may be configured to be a precise fit for ventilation mechanism 400 and therefore may have a shape corresponding to that of the ventilation mechanism 400, including a chamber 351 in a heel portion of the shoe to receive the intake reservoir 410, a chamber 353 in a toe portion of the shoe to receive the exhaust reservoir 430, and a channel 355 running between the intake reservoir 410 and the exhaust reservoir 430 to receive the connecting channel 450. In other embodiments, portions of ventilation mechanism 400 may be integrally formed in midsole 300.

The midsole 300 may be formed of any suitable material such as EVA, PU, TPU, polyolefin, or any combinations thereof. In some aspects, the midsole 300 may include an embedded shank 370 running in a longitudinal direction which is configured to provide stability and durability to the shoe. The embedded shank 370 may have a top surface which is generally flush with the top surface of the midsole 330 and a bottom surface which may extend into the midsole 300. The shank 370 may be formed from any suitable material such as steel, nylon, fiberglass, TPU, or polyvinyl chloride (PVC).

Ventilation Mechanism

The ventilation mechanism 400 is designed to pump air from the outside environment through the interior of the shoe in a single direction while a wearer is walking, so that the wearer's foot may be subjected to convective cooling. In general, the ventilation mechanism 400 comprises an intake reservoir 410, an exhaust reservoir 430, and a connecting channel 450 connecting the intake reservoir 410 and the exhaust reservoir 430. In some embodiments, the connecting channel 450 is configured to facilitate substantially one-way air flow in a direction from the intake reservoir 410 to the exhaust reservoir 430.

Figure 3A:
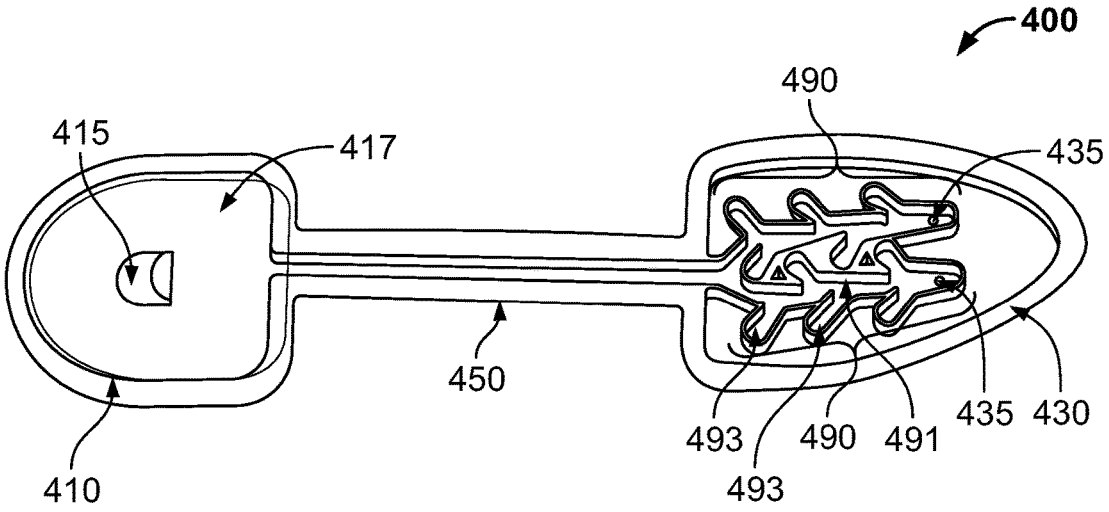
FIG. 3A is a view of a ventilation mechanism in accordance with a preferred embodiment of the present technology.
Figure 3B:
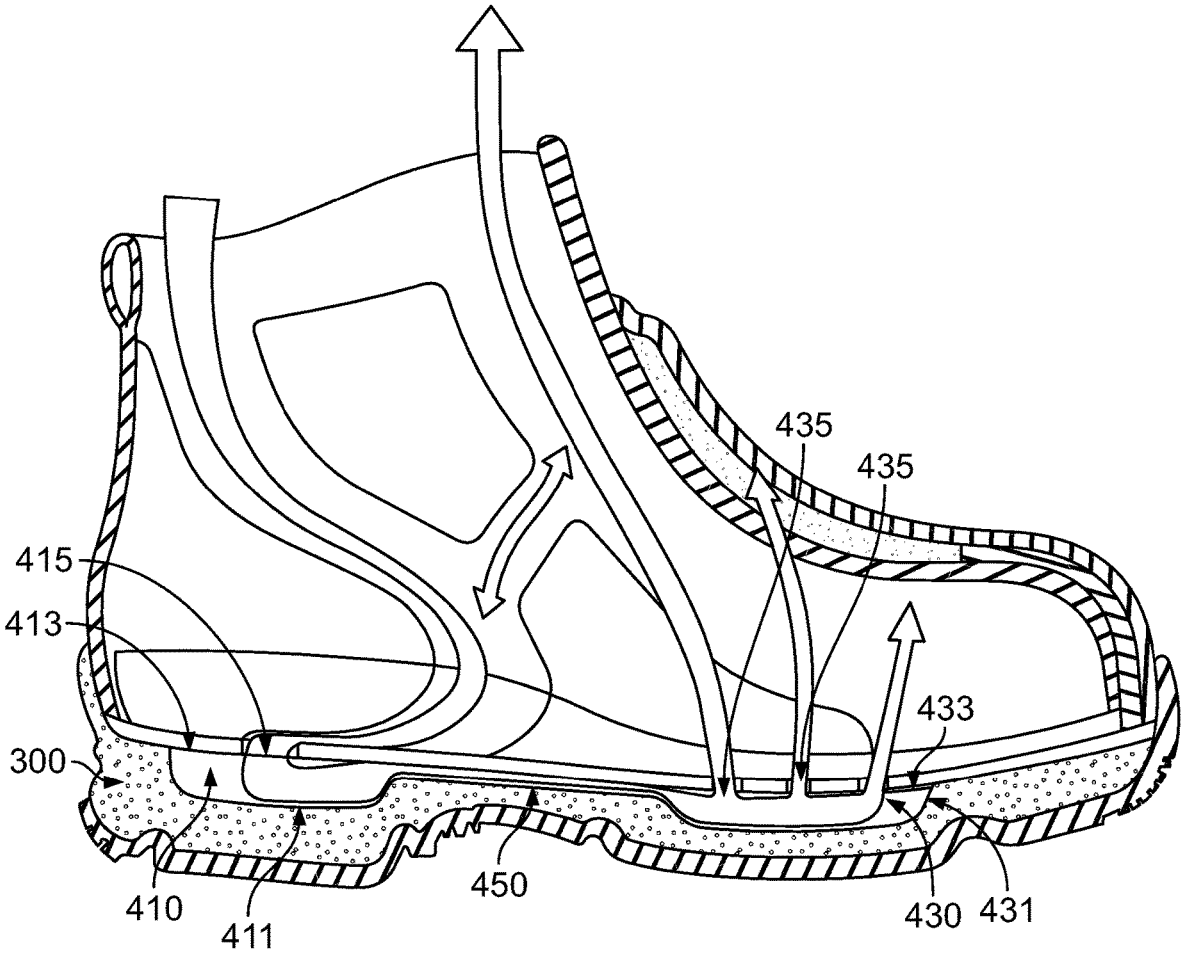
FIG. 3B is a longitudinal cross-sectional view of a shoe in accordance with aspects of the present technology, with particular emphasis on channels configured to provide airflow from and to the outside environment.

A preferred embodiment is shown in FIGS. 3A-B. As depicted in FIG. 3A, in a preferred embodiment, the ventilation mechanism 400 may be a separate hollow insert which may be housed within cavities 351, 353, 355 in the top surface of the midsole 300. In such an embodiment, the ventilation mechanism 400 may be formed from a material such as TPU or PVC.

As shown in FIG. 3B, the intake reservoir 410 may be positioned within a corresponding cavity 351 in the heel region of the midsole 300. The intake reservoir 410 has a top surface 413 which may be substantially planar and flush with the top surface 330 of the midsole and a nonplanar bottom surface 411 which may extend into the cavity 351 of the midsole from the top surface 413 so as to form a sealed, hollow intake reservoir between the two surfaces. The bottom surface 411 may extend into the cavity of the midsole to a depth, where the depth is the maximum distance between the top and bottom surfaces of the intake reservoir. The depth may be within the range of about 0.5 to about 2.5 cm, more preferably about 0.5 to about 1.5 cm, and in a preferred embodiment is about 2 cm. The volume of the intake reservoir 410 may be within the range of about 5 $cm^3$ to about 40 $cm^3$, more preferably about 15 $cm^3$ to about 30 $cm^3$, and in a preferred embodiment within about 20 $cm^3$ to about 30 $cm^3$. In a preferred embodiment, the top surface 413 of the intake reservoir 400 may be in the shape of a half-oval to mimic the contours of the heel of the shoe 100. However, the shape of the top surface 413 of the intake reservoir is not particularly limited and may be semicircular, circular, square, rectangular, oblong, or generally polygonal.

As shown in FIG. 3A, the top surface 413 of the intake reservoir 410 may include one or more perforations 415 which allow for air intake. The intake reservoir 410 may also contain an expanded foam material 417. Foam material 417 may be formed of expanded or porous materials such as EVA, PU, expanded TPU, or polyolefin. The foam material 417 may have a density/porosity within the range of about 80% to about 95%, more preferably about 80% to about 95%, or most preferably about 90% to about 95%. In some aspects, the intake reservoir 410 may be entirely filled with the foam material 417. In other aspects, the foam material 417 may occupy only 90% or less, 80% or less, or 70% or less of the volume of the intake reservoir. In a preferred embodiment, the foam material 417 only occupies 80% or less of the volume of the intake reservoir. In a preferred embodiment, as shown in FIG. 3A, the intake reservoir 410 is filled with foam 417 in sections where there is not a perforation 415 in the top surface 413 of the intake reservoir. In other words, where a perforation 415 is disposed in a section of the top surface 413, the volume of the intake reservoir 410 immediately below to this section, is free from the foam material 417.

The intake reservoir 410 and the foam material 417 are configured to be flexible and resilient such that when the top surface 413 of the intake reservoir is depressed, such as by the pressure of a wearer's heel during the beginning of a stride, the intake reservoir 410 is compressed and its volume decreases by at least 50%, more preferably by at least 60%, or in a preferred embodiment by at least 70%. When the pressure to the top surface 413 is removed, i.e. as the wearer transfers their weight to the forefoot as the stride progresses, the intake reservoir 410 and the foam material 417 are configured to rebound to their original shape and volume causing air to be drawn in through the intake perforations 415 in the top surface 413.

As shown in FIG. 3B, in a preferred embodiment, the exhaust reservoir 430 may be positioned within the corresponding cavity 353 in the toe region of the midsole 300. In alternative embodiments, the exhaust reservoir may be disposed elsewhere than in the toe region, for example in the heel, in the lining, or in the upper. The exhaust reservoir 430 has a top surface 433 which may be substantially planar and flush with the top surface 330 of the midsole and a nonplanar bottom surface 431 may extend into the cavity 353 of the midsole from the top surface 433 so as to form a sealed, hollow exhaust reservoir between the two surfaces. The bottom surface may extend into the cavity of the midsole to a depth. The depth may be within the range of about 0.1 to about 1.0 cm, more preferably about 0.1 to about 0.5 cm, and in a preferred embodiment is about 0.2 cm. The volume of the exhaust reservoir may be within the range of about 2.8 $cm^3$ to about 28 $cm^3$, more preferably about 2.8 $cm^3$ to about 14 $cm^3$, and in a preferred embodiment within about 2.8 $cm^3$ to about 5.6 $cm^3$. In a preferred embodiment, the top surface of the exhaust reservoir 430 may in the shape of a half-oval to mimic the contours of the toe of the shoe 100. However, the shape of the exhaust reservoir 430 is not particularly limited and may be semicircular, circular, square, rectangular, oblong, or otherwise generally polygonal.

In a preferred embodiment, the top surface 433 of the exhaust reservoir may include one or more perforations 435 which allow for air exhaust. In some aspects, the exhaust reservoir 430 may further include one or more directional flow channels 490. Such channels may be formed in the exhaust reservoir 430 so that they run in a longitudinal direction from the edge of the exhaust reservoir 430 closest to the heel of the shoe 100 to the edge of the exhaust reservoir 430 closest to the toe of the shoe 100. These channels are designed to facilitate substantially one-way air flow in a heel-to-toe direction. Each directional flow channel 490 comprises a main channel 491 extending in a substantially linear longitudinal direction, as well as multiple angled conduits 493 extending from the main channel on either longitudinal edge. The angled conduits 493 have a dead end or cul-de-sac configuration and their length is about 10% to about 40%, more preferably about 20% to about 30%, or most preferably about 25% to about 30% of the length of the main channel 491. The angled conduits 493 are positioned at an angle to the main channel 491 that is within the range of about 1 to about 90 degrees, more preferably about 30 to about 60 degrees, and most preferably about 40 to about 50 degrees, when measured in the desired direction of air flow. The angled conduits 493 may provide for generally laminar flow down the main channel 491 in a heel-to-toe direction, but create obstructed turbulent flow in the opposite direction, thus effectively facilitating heel-to-toe air flow and inhibiting toe-to-heel air flow. The perforations 435 in the top surface of the exhaust reservoir are positioned at the end of the directional flow channel 490 which is closest to the toe region. Thus, in order for air to exit these perforations 435, it easily flows through the directional flow channel 491 in a heel-to-toe direction. Conversely, air intake through these perforations 435 would require the air to flow in a toe-to-heel direction, which is inhibited by the directional flow channels 490.

As shown in FIGS. 2A and 3A-B, the ventilation mechanism 400 of the preferred embodiment may further comprise the connecting channel 450 which runs longitudinally from the intake reservoir 410, which may be located in a heel region, to the exhaust reservoir 430, which may be located in a toe region, so that the two reservoirs are in fluid communication with one another. In some embodiments, the exhaust reservoir may be disposed elsewhere than in the toe region, for example in the heel, in the lining, or in the upper. The connecting channel 450 may be positioned within the corresponding cavity 355 running longitudinally through a midfoot section of the midsole 300. The connecting channel 450 has a top surface 453 which may be substantially planar and flush with the top surface 330 of the midsole and a nonplanar bottom surface 451 which may extend into the cavity 355 of the midsole from the top surface 453 so as to form a sealed, hollow tube or channel between the intake and exhaust reservoirs. The bottom surface 451 may extend into the cavity 455 of the midsole to a depth, where the depth is the maximum distance between the top and bottom surfaces of the intake reservoir. The depth may be within the range of about 0.05 to about 0.5 cm, more preferably about 0.2 to about 0.5 cm, and in a preferred embodiment is about 0.4 cm. The cross sectional area of the connecting channel 450 may be within the range of about 0.02 $cm^2$ to about 0.1 $cm^2$, more preferably about 0.02 $cm^2$ to about 0.08 $cm^2$, and in a preferred embodiment within about 0.02 $cm^2$ to about 0.04 $cm^2$. In a preferred embodiment, a cross sectional shape of the connecting channel 450 is rectangular. However, the cross sectional shape of the connecting channel 450 may be semicircular, circular, square, oblong, or otherwise generally polygonal. In some aspects, the connecting channel 450 may comprise a directional flow channel 490.

In some aspects, the connecting channel 450 may connect the intake reservoir 410 to the directional flow channels 490 of the exhaust reservoir 430. Thus, during a stride, the intake reservoir 410 may be compressed by the downwards pressure of the wearer's heel and the upwards pressure of the raised platform 212 of the outsole 200, expelling the air held within into the connecting channel 450 and through the directional flow channels 490 to be exhausted through the perforations 435 at the end of the directional flow channels 490. As the wearer transfers weight to the toe during a stride, the pressure on the intake reservoir 410 may be relieved causing the intake reservoir 410 to expand and refill with air through the perforations 415 in its top surface in order to begin the process again. Because the directional flow channels 490 facilitate air flow in a heel-to-toe direction and inhibit air flow in a toe-to-heel direction, the intake reservoir 410 is primarily refilled from air entering the perforations 415 in the intake reservoir 410 rather than from air flowing into the perforations 435 in the exhaust reservoir 430. More specifically, in a preferred embodiment, the directional flow channels 490 provide for about 65% to about 90% (by volume) refill of the intake reservoir 410 from the perforations 415 in the intake reservoir 410, based on the total volume of air which refills the intake reservoir 410. More preferably, at least 75% of the refill volume comes from the perforations 415 in the intake reservoir 410, and most preferably about 75%-80%. Thus, the ventilation mechanism 400 provides for continuous, substantially one-way air circulation through the shoe.

Figure 4A:
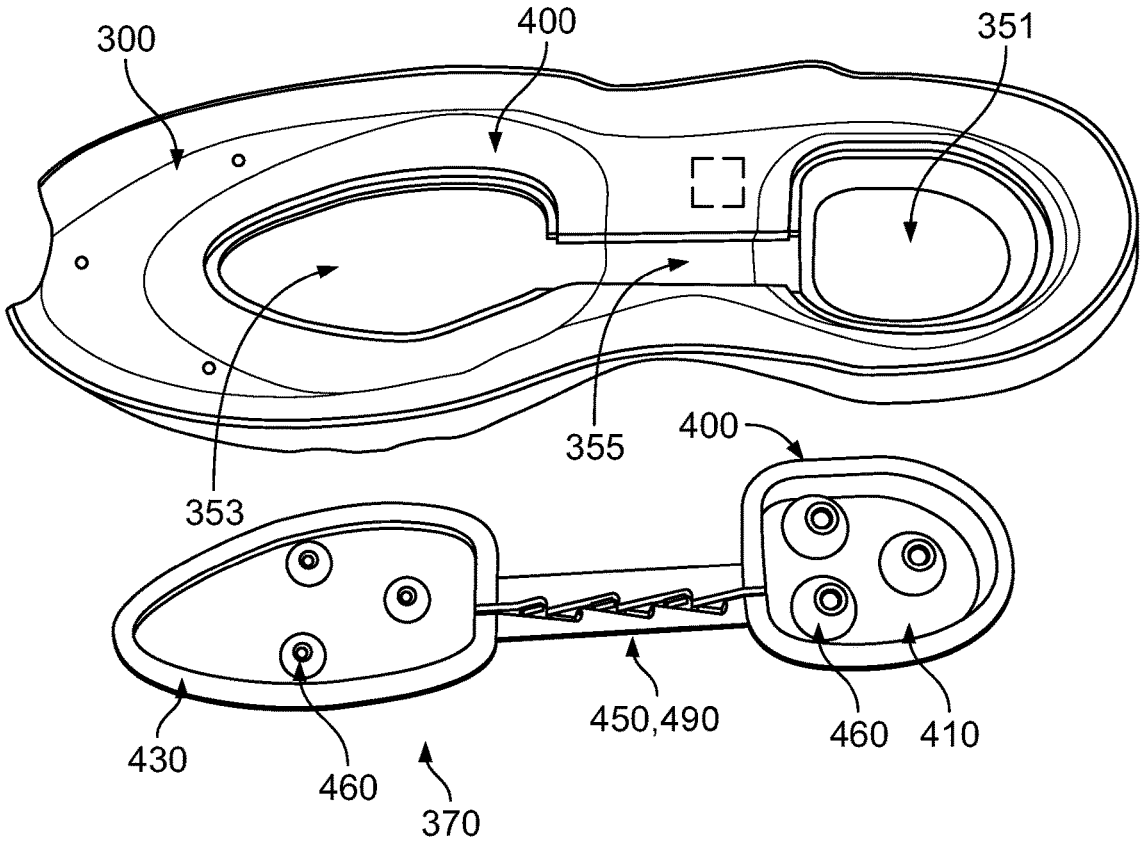
FIG. 4A is an expanded view of a ventilation mechanism in accordance with an alternative embodiment of the present technology.
Figure 4B:
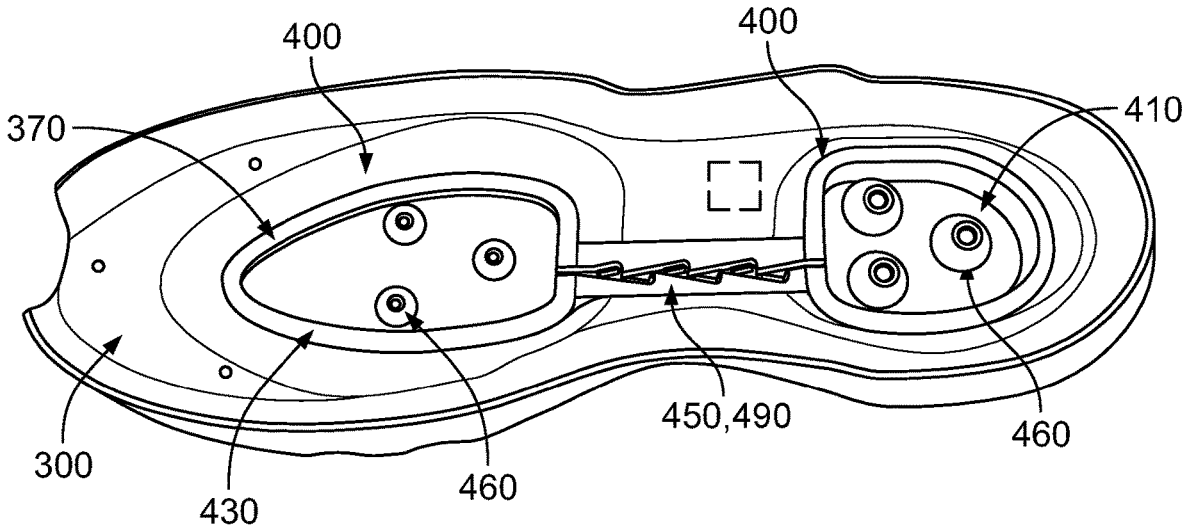
FIG. 4B is a top down perspective view of a ventilation mechanism in accordance with an alternative embodiment of the present technology.

An alternative embodiment is depicted in FIGS. 4A-B. This alternative embodiment provides a ventilation mechanism 400 which generally comprises an intake reservoir 410, an exhaust reservoir 430, and a connecting channel 450. However, these components are formed integrally into the midsole 300, shank 370, and baseboard 500 of the shoe. Specifically, the bottom surfaces of an intake reservoir 411, an exhaust reservoir 431, and a connecting channel 451 may be formed by depressions in the top surface of the shank 370. Thus, the shank may be embedded into midsole such that the intake reservoir 410 may be positioned within a corresponding cavity in the heel region of the midsole 351, the exhaust reservoir 430 may be positioned in a corresponding cavity 353 in the toe region of the midsole, and the connecting channel 450 may be fitted into a cavity 355 running longitudinally between the heel and toe regions of the midsole 300. In some embodiments, the exhaust reservoir may be disposed elsewhere than in the toe region, for example in the heel, in the lining, or in the upper.

The bottom surface of intake reservoir 410 formed in the shank 370 may extend into the cavity 351 of the midsole 300 to a depth, where the depth is the maximum distance between the top and bottom surfaces of the intake reservoir. The depth may be within the range of about 0.5 to about 2.5 cm, more preferably about 0.5 to about 1.5 cm, and in a preferred embodiment is about 2 cm. The volume of the intake reservoir 410 may be within the range of about 5 $cm^3$ to about 40 $cm^3$, more preferably about 15 $cm^3$ to about 30 $cm^3$, and in a preferred embodiment within about 20 $cm^3$ to about 30 $cm^3$. In a preferred embodiment, the intake reservoir 410 may be in the shape of a half-oval to mimic the contours of the heel of the shoe 100. However, the shape of the top surface of the intake reservoir 410 is not particularly limited and may be semicircular, circular, square, rectangular, oblong, or generally polygonal. In some embodiments, the intake reservoir 410 may include one or more lugs 460 which extend upwards from the bottom surface of the intake reservoir 410 such that they are no less than 90%, more preferably no less than 95%, or most preferably no less than 99% of the depth of the intake reservoir 410. Lugs having a height below the specified ranges may produce unfavorable results such as squeaking, sliding of the lugs against the opposing surface, and deformation of the baseboard or insole of the shoe. The lugs 460 are configured to flex in order to allow for partial compression and deformation of the intake reservoir 410 (e.g., from weight transfer to a heel region of the shoe during a wearer's stride) while preventing complete collapse of the intake reservoir 410 when pressure is applied to it.

As shown in FIGS. 4A-B, the bottom surface of the exhaust reservoir 430 formed in the shank 370 may extend into the cavity 353 of the midsole to a depth, where the depth is the maximum distance between the top and bottom surfaces of the exhaust reservoir 430. The depth may be within the range of about 0.1 to about 1.0 cm, more preferably about 0.1 to about 0.5 cm, and in a preferred embodiment is about 0.2 cm. The volume of the exhaust reservoir 430 may be within the range of about 2.8 $cm^3$ to about 28 $cm^3$, more preferably about 2.8 $cm^3$ to about 14 $cm^3$, and in a preferred embodiment within about 2.8 $cm^3$ to about 5.6 $cm^3$. A ratio of the volume of the intake reservoir to the volume of the exhaust reservoir may be within a range of about 1.5 to about 3, more preferably about 2 to about 3, and most preferably about 2.5 to about 3. In a preferred embodiment, the exhaust reservoir 430 may in the shape of a half-oval to mimic the contours of the toe of the shoe. However, the shape of the exhaust reservoir 430 is not particularly limited and may be semicircular, circular, square, rectangular, oblong, or otherwise generally polygonal. In some aspects, the exhaust reservoir 430 formed in the top surface of the shank 370 may further include one or more directional flow channels 490 which run in a longitudinal direction from the edge of the exhaust reservoir 430 closest to the heel of the shoe 100 to the edge of the exhaust reservoir 430 closest to the toe of the shoe 100. These channels 490 are designed to provide for substantially one-way air flow in a direction from the intake reservoir to the exhaust reservoir. In some embodiments, the exhaust reservoir 430 may include one or more lugs 460 which extend upwards from the bottom surface of the exhaust reservoir 430 such that they have a height that is no less than 90%, more preferably no less than 95%, or most preferably no less than 99% of the depth of the exhaust reservoir 430. Lugs having a height below the specified ranges may produce unfavorable results such as squeaking, sliding of the lugs against the opposing surface, and deformation of the baseboard or insole of the shoe. The lugs 460 are configured to flex in order to allow for partial compression and deformation of the exhaust reservoir 430 (e.g., from weight transfer to a toe region of the shoe during a wearer's stride) while preventing complete collapse of the exhaust reservoir 430 when pressure is applied to it.

As shown in FIGS. 4A-B, the bottom surface of the connecting channel 450 formed in the top surface of the shank 370 may be positioned within the corresponding cavity 355 running longitudinally through a midfoot section of the midsole 300. The bottom surface may extend into the cavity 355 of the midsole to a depth, where the depth is the maximum distance between the top and bottom surfaces of the connecting channel 450. The depth may be within the range of about 0.05 to about 0.5 cm, more preferably about 0.2 to about 0.5 cm, and in a preferred embodiment is about 0.4 cm. The cross sectional area of the connecting channel 450 may be within the range of about 0.02 $cm^2$ to about 0.1 $cm^2$, more preferably about 0.02 $cm^2$ to about 0.08 $cm^2$, and in a preferred embodiment within about 0.02 $cm^2$ to about 0.04 $cm^2$. In a preferred embodiment, a cross sectional shape of the connecting channel 450 is rectangular. However, the cross sectional shape of the connecting channel may be semicircular, circular, square, oblong, or otherwise generally polygonal. In some aspects, the bottom surface of the connecting channel 450 formed in the shank may comprise a directional flow channel 490.

In this embodiment, the baseboard 500 may be disposed on the top surface of the midsole 300 and over the embedded shank 370 such that it forms a top surface for the intake reservoir, exhaust reservoir, and connecting channel. In some aspects, the baseboard may have perforations positioned in a heel region and a toe region in order to allow air flow in and out of the intake and exhaust reservoirs, respectively.

Figure 5A:
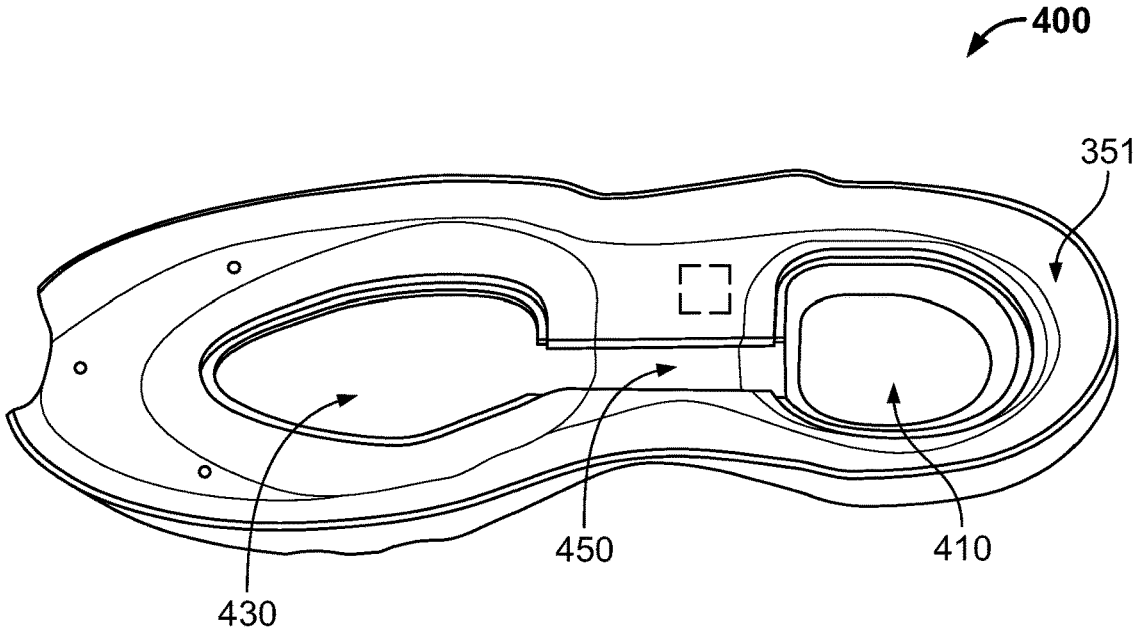
FIG. 5A is a top down view of a midsole and bottom surface of a ventilation mechanism in accordance with an alternative embodiment of the present technology.
Figure 5B:
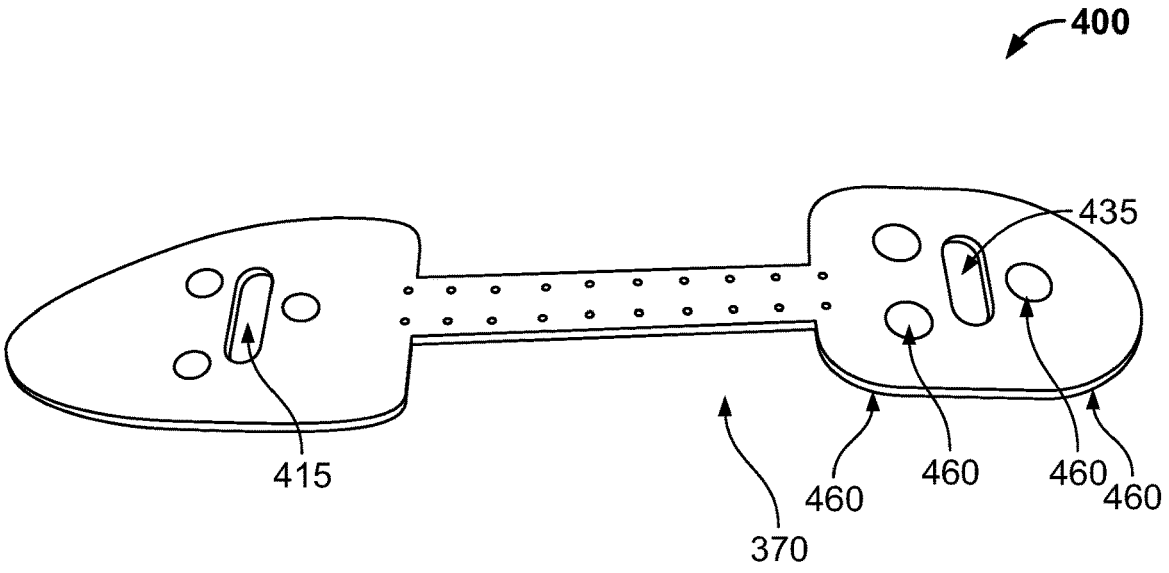
FIG. 5B is a top down view of a shank and top surface of a ventilation mechanism in accordance with an alternative embodiment of the present technology.

FIGS. 5A-B show another embodiment of the ventilation mechanism 400. This embodiment provides a ventilation mechanism which generally comprises an intake reservoir 410, an exhaust reservoir 430, and a connecting channel 450 formed integrally into the midsole 300, shank 370, and baseboard 500 of the shoe. However, the bottom surfaces of an intake reservoir 410, an exhaust reservoir 430, and a connecting channel 450 may be formed by depressions in the top surface of the midsole 300 and their top surfaces may be provided by a shank 370. Thus, the shank 370 may be laid over cavities in the top surface of the midsole 300 such that a hollow intake reservoir 410 may be formed in a heel region of the midsole 300, a hollow exhaust reservoir 430 may be formed in a toe region of the midsole 300, and a hollow connecting channel 450 may be formed in a longitudinal region running between the heel and toe regions of the midsole 300. In some embodiments, the exhaust reservoir may be disposed elsewhere than in the toe region, for example in the heel, in the lining, or in the upper. In some aspects, the intake and exhaust reservoirs may include one or more lugs 460 which extend downwards from the top surface provided by the shank 370 and towards the bottom surface provided by the midsole 300 such that they have a height that is no less than 90%, more preferably no less than 95%, or most preferably no less than 99% of the depth of the intake or exhaust reservoir. The shank 370 may be provided with perforations 415, 435 in heel and toe regions in order to allow air flow into the intake reservoir and out of the exhaust reservoir, respectively.

Figure 6:
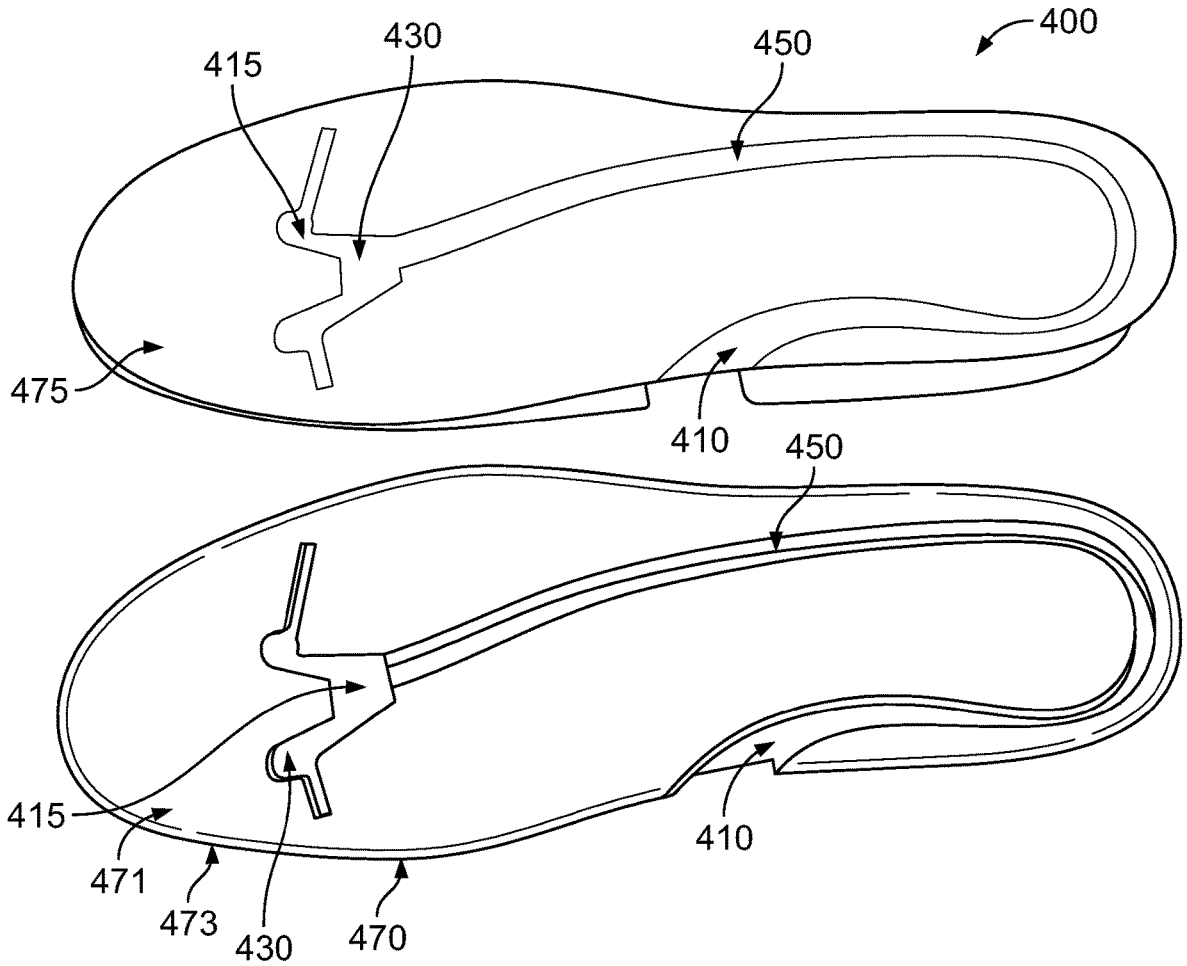
FIG. 6 is a bottom up perspective view of a ventilation mechanism in accordance with an alternative embodiment of the present technology.

FIG. 6 shows yet another embodiment of the ventilation mechanism 400. Such an embodiment provides a ventilation mechanism which is formed integrally into a removable insert 470 which may be provided to a shoe 100. The removable insert 470 has a bottom surface 471 which is configured to be closest to the outsole 200 when inserted into the cavity of a shoe 100 and a top surface 473 which is configured to be closest to the foot of a wearer. In some embodiments, the removable insert 470 may replace the insole 600, while in other embodiments, it may be used in addition to the insole 600. The bottom surface 471 of the removable insert 470 may comprise an intake reservoir 410 in a heel or instep region, an exhaust reservoir 430 in a toe region, and a connecting channel 450 running between the intake and exhaust reservoirs. In some embodiments, the exhaust reservoir may be disposed elsewhere than in the toe region, for example in the heel, in the lining, or in the upper. In an embodiment, the top surfaces of the intake reservoir, exhaust reservoir, and connecting channel may be formed by depressions in the bottom surface 471 of the removable insert 470. In such an embodiment, a substantially planar cover sheet 475 may be adhered to the bottom surface 471 of the removable insert 470 over the top of the depressions so that it forms a planar bottom surface of the intake 410 and exhaust 430 reservoirs and the connecting channel 450.

As shown in FIG. 6, the intake reservoir 410 and exhaust reservoir 430 of this embodiment may have cross sectional areas or diameters that are widened with respect to those of the connecting channel 450. In some embodiments, the connecting channel 450 may run in a substantially linear route from the intake reservoir 410 to the exhaust reservoir 430, while in other embodiments, the connecting channel 450 may comprise a more circuitous nonlinear shape. In a preferred embodiment, the connecting channel 450 may comprise a hook or loop configuration which runs substantially parallel to the periphery of the heel region. In the exhaust reservoir, a perforation 415 may be provided which extends all the way through the removable insert so that air may be exhausted from the removable insert 470 and past its top surface. Similarly, the intake reservoir 410 may be designed to connect to or otherwise communicate with air flow channels 1100 formed along the inside surface of the upper 700 in order to draw air from the outside environment. In some embodiments, the connecting channel 450 and/or the exhaust reservoir 430 may comprise directional flow channels 490.

Baseboard

As shown in FIG. 1, the baseboard 500 may be a substantially planar member having a bottom surface configured to contact the top surfaces of both the midsole 300 and, in a preferred embodiment, the ventilation mechanism 400 and a top surface which is configured to contact the insole 600. In some embodiments, the baseboard 500 may form a top surface of the intake reservoir 410, exhaust reservoir 430, and connecting channel 450. The baseboard 500 may be permanently secured to the midsole 300 by an adhesive, or alternatively, by stitching or injection molding. In some aspects, the baseboard 500 may have one or more cut-outs 510, 530 which are configured to sit over the intake reservoir 410 and the exhaust reservoir 430 in order to facilitate air flow through the ventilation mechanism 400. These cut-outs may filled with inserts made of a mesh, foam, fabric, or other breathable membrane or, alternatively, may be free from any filler or covering material. The baseboard 500 may be constructed of materials such as PET, polyester, injected nylon, or polyethylene. The baseboard 500 may have a thickness within the range of about 0.1 to about 0.5 cm.

Insole

Figure 7A:
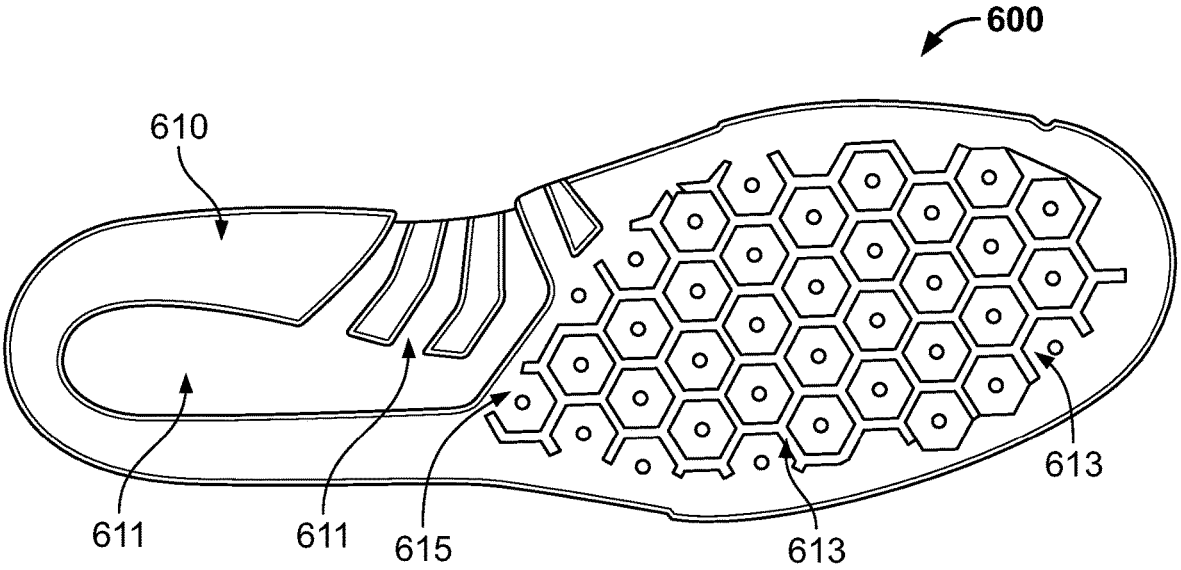
FIG. 7A is a view of the bottom surface of an insole of a shoe in accordance with aspects of the present technology.
Figure 7B:
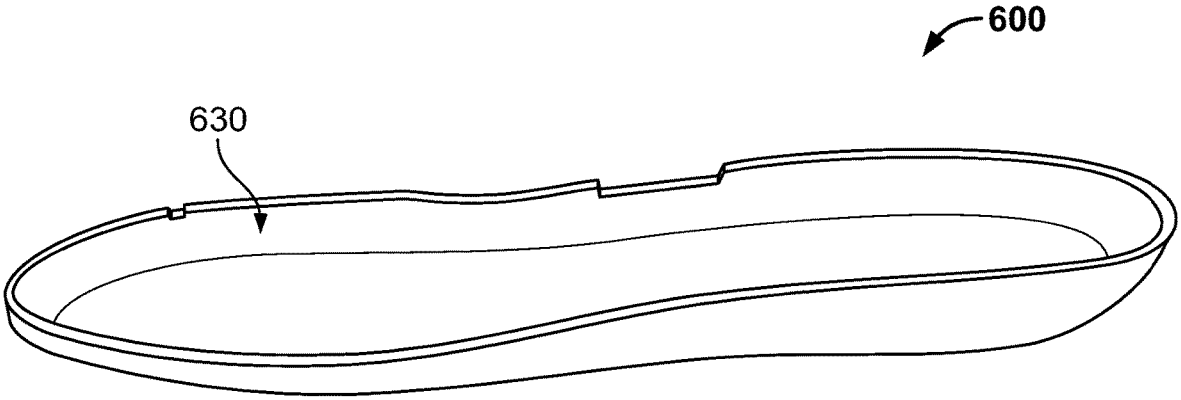
FIG. 7B is a view of the top surface of an insole of a shoe in accordance with aspects of the present technology.

As depicted in FIGS. 7A-B, the insole 600 comprises a flexible insert which has a bottom surface 610 configured to contact the baseboard 500 and a top surface 630 configured to receive the foot of a wearer. In some aspects, the insole 600 may be removable from the shoe. The insole 600 may be primarily formed from a polyurethane material such as polyurethane, EVA, or TPU.

In some aspects, the top surface 630 of the insole may be covered by a thin layer of fabric material such as polyester. This fabric layer may be permanently adhered to the insole using an adhesive or the like. In some embodiments, the top surface 630 of the insole may be substantially planar, while in other embodiments, the top surface 630 may include raised portions around the edge of a heel region or along an instep region in order to cradle and provide support for a wearer's foot.

In some embodiments, the ventilation mechanism may be disposed within insole 600. In some aspects, the ventilation mechanism may be a separate hollow insert which may be housed within cavities disposed within the insole. In other embodiments, the ventilation mechanism may be formed integrally within the material of the insole, such that the material of the insole defines the hollow intake reservoir, the exhaust reservoir, and the connecting channel. In some aspects, the bottom surface 610 of the insole may include an air intake pattern 611 in a heel region and an air exhaust pattern 613 in a toe and forefoot region. The air intake pattern 611 in the heel region may include a depressed or hollowed out area in the center of the heel region which is of a lower elevation than the edges of the heel. The intake pattern 611 may further include one or more channels of similarly lower elevation, cut into the bottom surface 610 of the insole, and running from the depression in the heel area towards the periphery of the insole 600 in the area of the midfoot or the instep. These channels may connect to or communicate with the air flow channels 1100 in the upper 700 to provide an avenue for air flow from the outside environment into the shoe 100 and underneath a heel portion of the insole 600 so that it may be drawn into the intake reservoir 410 of the ventilation mechanism 400.

The air exhaust pattern 613 may be disposed in a toe and forefoot region of the bottom surface 610 of the insole and separated from the air intake pattern 611 by a raised ridge 615. The air exhaust pattern 613 may include a pattern of raised lugs which may be in the shape of diamonds, circles, squares, rectangles, or other polygons. In a preferred embodiment, these raised lugs are hexagonal in shape. The raised lugs are positioned so that they define a network of depressed channels between their respective edges. Each of the raised lugs includes a slight depression in its center with a perforation that extends entirely through the insole. The raised pattern, depressed channels, and perforations allow for air exhaust flow exiting the ventilation mechanism 400 to flow through a forefoot portion of the shoe 100 beneath the insole 600 before exiting through the perforations in the air exhaust pattern 613 of the insole to contact and cool a wearer's foot.

Upper

Figure 8A:
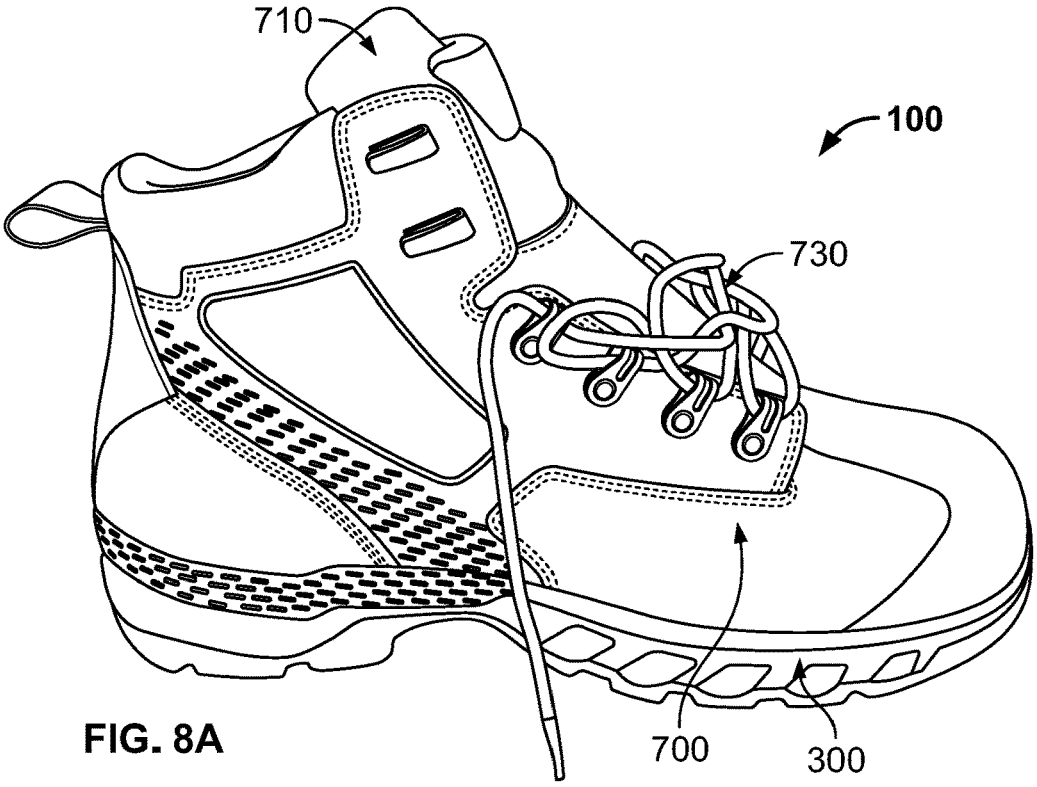
FIG. 8A is a side view of a shoe in accordance with aspects of the present technology.
Figure 8B:
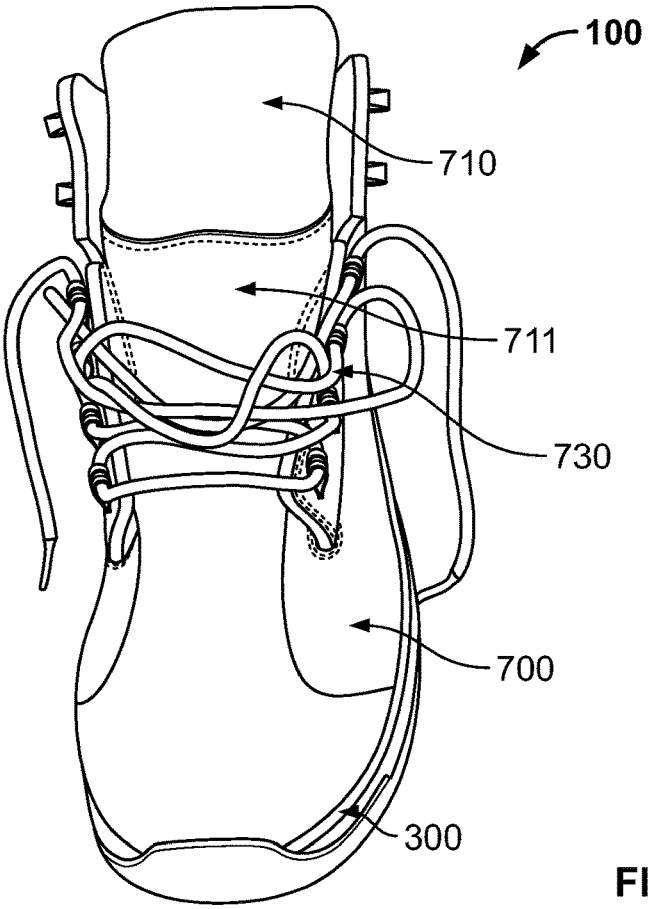
FIG. 8B is a front view of a shoe in accordance with aspects of the present technology.

As shown in FIGS. 8A-B, the upper 700 extends upwards from the midsole 300 to form a cavity configured to receive a user's foot. The upper 700 has an inner surface configured to receive a wearer's foot and promote air flow within the shoe 100 and an outer surface configured to repel water and otherwise interact with the outside environment. The upper 700 may be constructed from one of a number of waterproof membranes, including waterproof leather, silicone seam seal, or a waterproof membrane material with a heat-welded seam seal material.

The upper 700 may additionally include a tongue portion 710 and a lacing component 730. The tongue portion 710 may be configured to be pulled back by a wearer so that a foot may be inserted more easily into the cavity of the shoe 100. Once the foot is settled within the cavity of the shoe 100, the tongue 710 may tightened to the foot using the lacing component 730 so that the wearer's foot fits snugly and securely within the shoe. In some aspects, the tongue portion 710 of the upper 700 may have a raised ventilation channel 711 running longitudinally from a toe portion of the upper 700 to the edge of the shoe cavity. Ventilation channel 711 may be held away from the foot, even when the lacing component 730 is tightened, to allow for air flow up and out of the shoe.

Protective Toe Cap

Figure 9A:
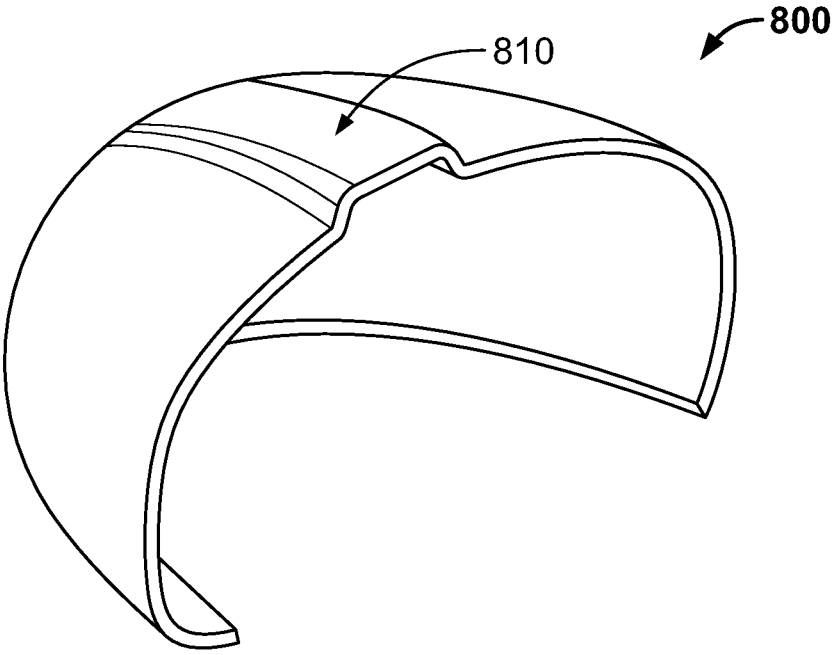
FIGS. 9A-B are views of a protective toe cap of a shoe in accordance with aspects of the present technology.
Figure 9B:
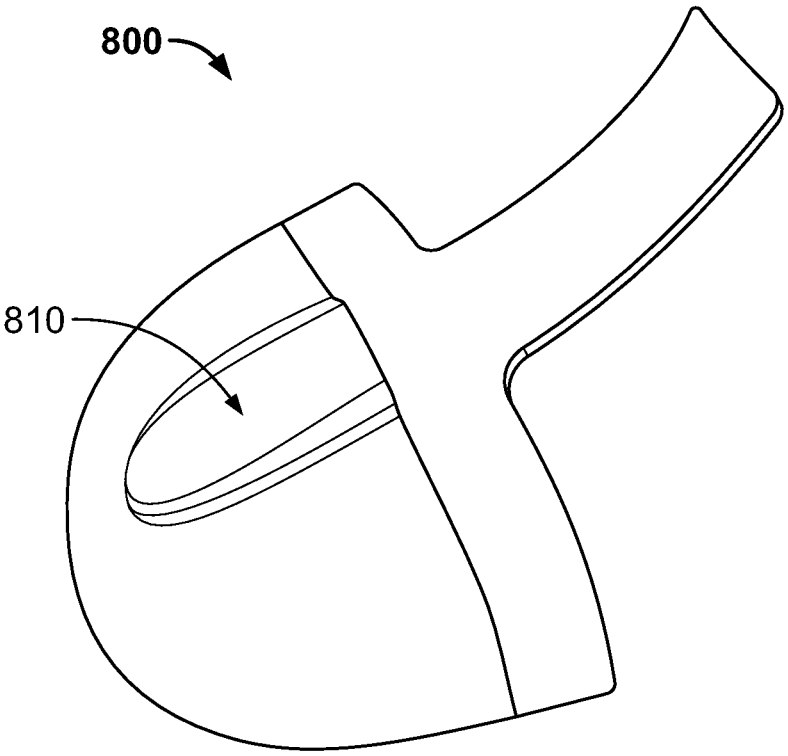

FIGS. 9A-B depict various views of a protective toe cap 800, in accordance with an embodiment of the invention. The protective toe cap 800 is shaped to fully cover a user's toes and provide protection therefor. Thus, the protective toe cap 800 is shaped as a hemi-dome in some embodiments. The protective toe cap 800 includes an open underside sized to accommodate a user's toes, and has a protrusion forming a ventilation channel 810 running longitudinally along the underside. Although a single protrusion is shown, multiple protrusions forming multiple ventilation channels 810 are equally possible and contemplated by the present invention.

The protrusion of FIGS. 9A-B extends from a midfoot edge of the protective toe cap 800 towards a forefoot edge of the protective toe cap 800 and tapers in the direction of the forefoot edge. As such, a height of the ventilation channel is at a maximum at the midfoot edge of the toe cap 800 and progressively decreases in the direction of forefoot edge until the ventilation channel 810 disappears along the underside of the toe cap 800. In an embodiment, the lateral cross sectional area of the ventilation channel 810 is shaped as a quadrangle, although it could be semi-circular, triangular, hexagonal, pentagonal, polygonal, or any other shape that adequately provides a ventilation channel. In some embodiments, the ventilation channel 810 may be shaped to engage with the corresponding ventilation channel 711 of the tongue portion of the upper in order to provide a continuous channel from the toe of the shoe 100 to the edge of the cavity of the upper 700.

The protective toe cap is 800, in an embodiment, composed of a metal or metal alloy material (e.g., titanium) or any other material of a sufficient strength to satisfy safety standards for protective footwear, such as ASTM F2413-11.

Ankle Pads

As depicted in FIG. 1, the ankle pads 900 comprise raised pads permanently affixed to the inner surface of the upper 700 on laterally opposing sides of the shoe 100. In some embodiments, the positioning of the ankle pads 900 may be substantially symmetrical, but in a preferred embodiment is asymmetrical. The ankle pads 900 may be circular, oval, triangular, diamond, square, rectangular, or otherwise polygonal in shape. The ankle pads 900 are designed to extend from the upper 700 to cause the lining 1000 to protrude and contact the foot and ankle of the wearer. These protruding contact points work to hold the upper 700 off the wearer's foot in adjacent regions in order to create channels 1100 for air flow from the outside environment into the shoe 100. In a preferred embodiment, the shape of the ankle pads 900 is selected to contact the ankle of a wearer in anatomical positions which are free of major blood vessels, thereby creating air flow channels 1100 in the adjacent areas where such blood vessels are located. This helps to enhance cooling of the foot and also to prevent vascular constriction and encourage circulation to the foot of a wearer.

The ankle pads 900 may be constructed from materials such as open-cell PU, TPU, EVA, or neoprene, and affixed to the upper by stitching, adhesives, high frequency welding or injected directly to the upper.

Lining

Figure 10:
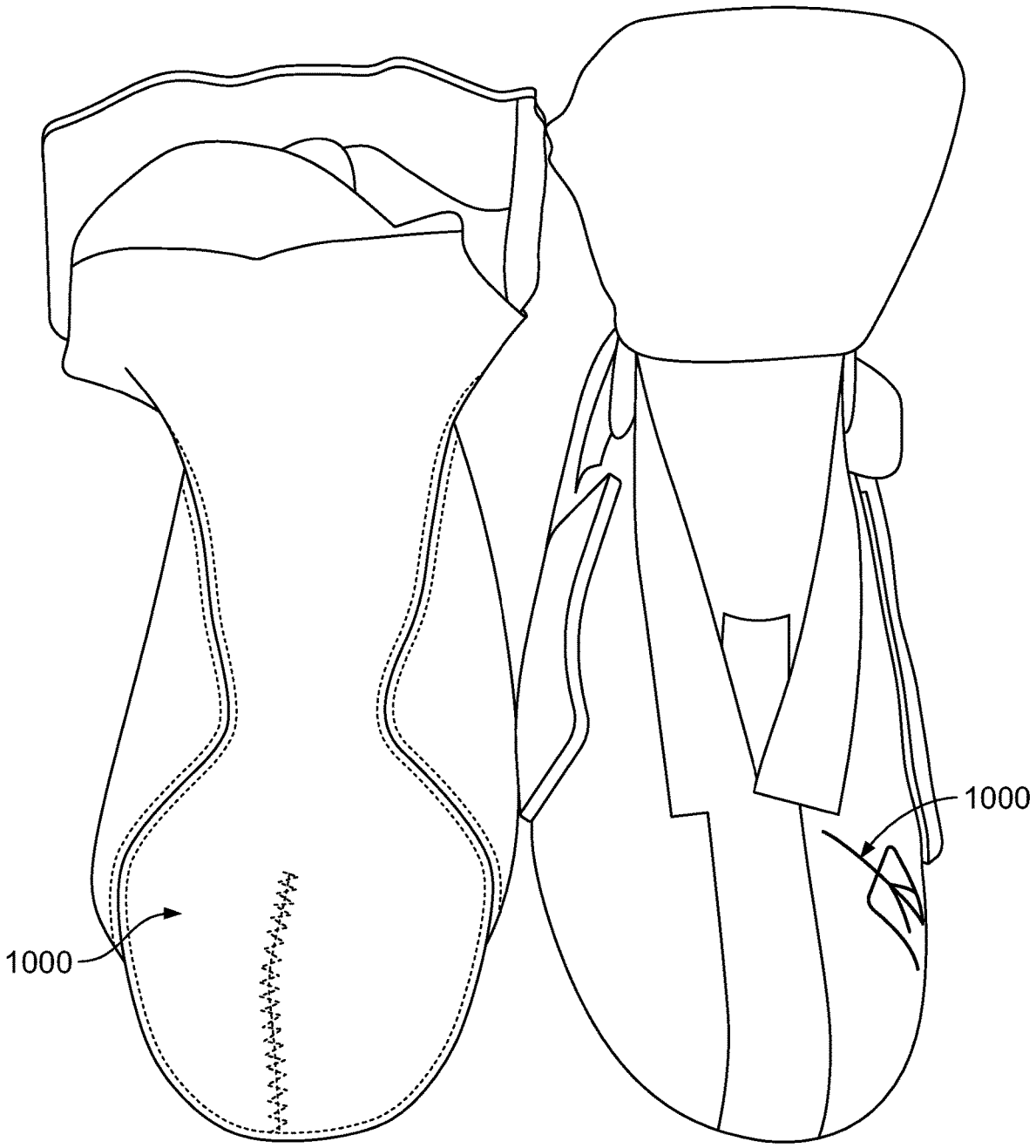
FIG. 10 is a view of a liner of a shoe in accordance with aspects of the present technology.

As shown in FIGS. 1 and 10, the lining 1000 comprises a porous fabric lining which is disposed on the inner surface of the upper 700, overtop of the protective toe cap 800 and the ankle pads 900, such that it covers both of these elements as well as the entire inner surface of the upper 700. The lining 1000 is permanently secured in position by stitching to the upper 700.

The lining 1000 may be constructed from materials such as polyester or knit nylon. The material of the lining is porous and conducive to air flow, as well as efficient for wicking moisture away from the foot of a wearer.

Airflow Channels

As shown in FIG. 1, in some aspects, the ankle pads 900, lining 1000, and ventilation channels 810, 711 of the protective toe cap and the upper are positioned to define airflow channels 1100 which are held away from close contact with the foot and ankle of a wearer so as to allow intake and exhaust of air from and to the outside environment.

In particular, an airflow channel 1100 to allow exhaust of air from the ventilation mechanism 400 may be formed by the ventilation channels 810, 711 in the protective toe cap 800 and the tongue portion 710 of the upper 700. Airflow channels 1100 to allow intake of air may be formed in the areas adjacent to the ankle pads 900 and in some embodiments, may direct air from the outside environment into the hollowed portion of the intake pattern 611 on the bottom surface of the insole 600 to allow outside air to be draw into the intake reservoir 410 of the ventilation mechanism 400.

Pump-Ventilation of Shoe

The various aspects of the present technology function cohesively to provide a continuous flow of outside air through the shoe in a direction from the intake reservoir to the exhaust reservoir. In a preferred embodiment, this direction is a heel-to-toe direction. In such an embodiment, when a wearer begins a stride by transferring weight to the heel of the foot, the intake reservoir 410 is compressed by the downward pressure of a user's foot and the upwards pressure provided by raised platform 212 of the outsole 200, causing the air inside to be expelled through the connecting channel 450 and into the directional flow channels 490 of the exhaust reservoir 430. Because the air flow is in the heel-to-toe direction generally permitted by the directional flow channels 490, the air easily passes through the channels 490 and is expelled out of the exhaust reservoir 430 through the perforations 435 at the end of the channels 490. The expelled air then flows through the cut-out 530 provided in the baseboard 500 for this purpose and through the exhaust pattern 613 and perforations in the insole 600. After the air passes through the perforations of the insole 600, it may travel upwards through the corresponding ventilation channels 810, 711 in the protective toe cap 800 and the tongue 710 before being finally expelled into the outside environment.

As the stride progresses, the wearer will transfer weight from the heel of the foot through the midfoot and the toe. As the pressure on the intake reservoir 410 is relieved, the intake reservoir 410 may expand to its original volume, causing it to draw air in through the perforations 415 on its surface. Because the directional flow channels 490 facilitate air flow in a heel-to-toe direction and inhibit air flow in a toe-to-heel direction, the intake reservoir 410 will be refilled primarily from air entering the perforations 415 in the intake reservoir 410 rather than from air flowing into the perforations 435 in the exhaust reservoir 430. Thus, the intake reservoir 410 draws in air present beneath a heel region of the insole 600. The intake pattern 611 of the insole 600 assists with channeling air from the airflow channels 1100 of the upper 700 to bottom surface of the insole 600, and thereby a substantially continuous flow of air from the outside environment is provided to the intake reservoir 410 of the shoe. In this manner, the present technology provides for generally continuous, one-way air circulation through the shoe.

EXAMPLES

Example 1

Figure 11:
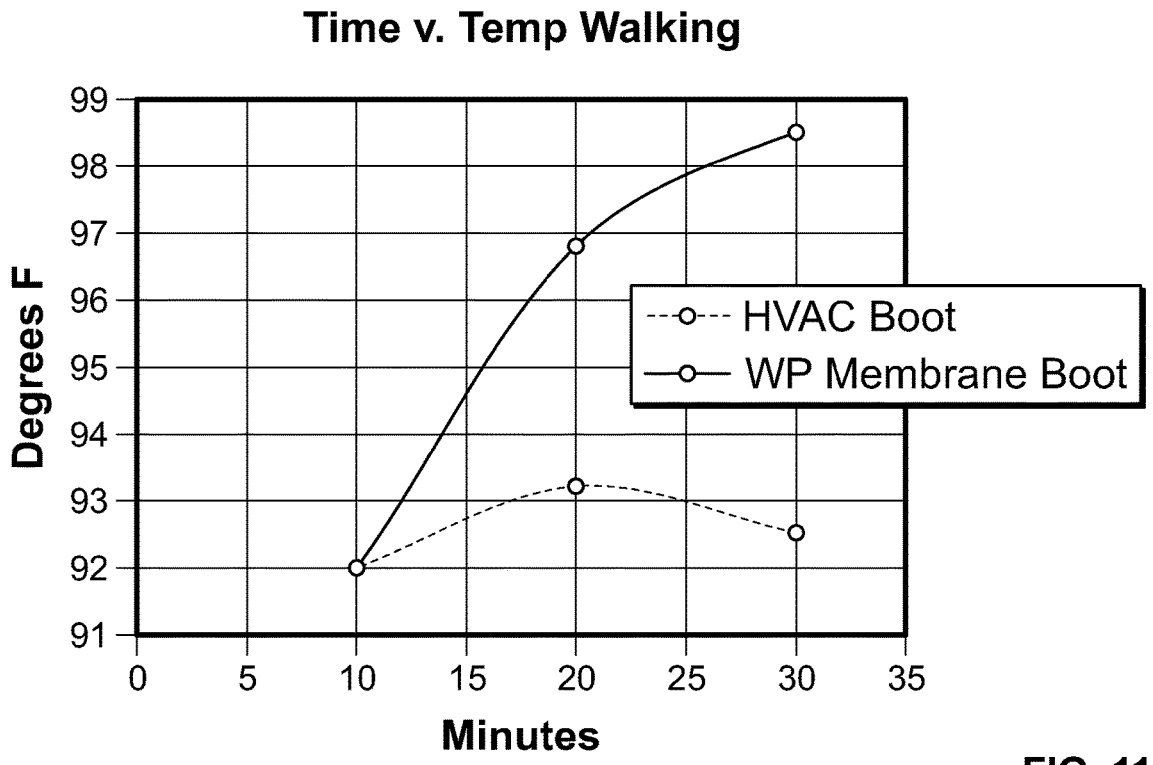
FIG. 11 is a chart showing the temperature of a wearer's foot over time, as a result of the test set out in Example 1.

In order to measure the cooling effect of the present technology during use by a wearer, a conventional waterproof boot ("WP membrane boot") was compared to a ventilated boot ("HVAC boot"). The conventional boot was constructed of a standard waterproof membrane upper and did not include a ventilation mechanism or airflow channels. The ventilated boot included aspects of a preferred embodiment of the present technology including a ventilation mechanism and airflow channels. To test the boots, a wearer placed a conventional boot on his left foot and a ventilated boot on his right foot and walked on a treadmill at a pace of 3.5 mph for a period of 30 minutes. The temperature of the wearer's right and left feet were measured every 10 minutes by infrared camera. The results are shown in FIG. 11.

Example 2

Figure 12:
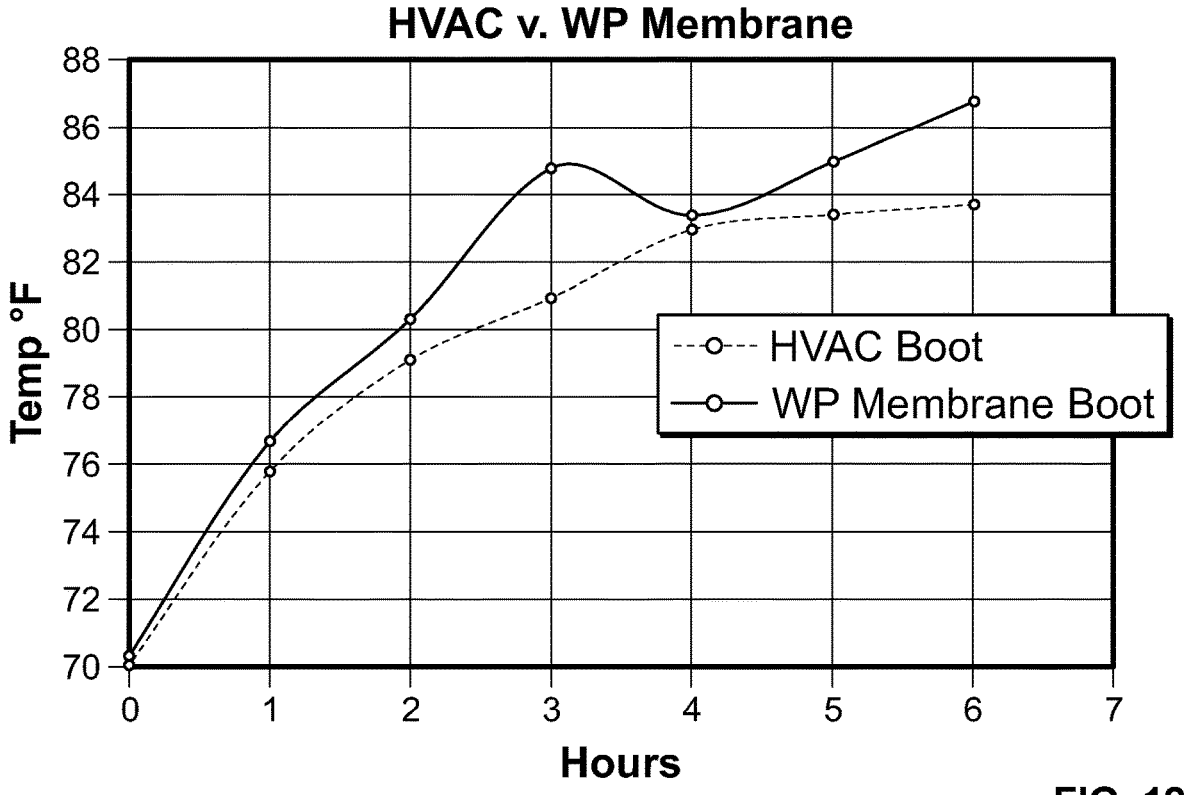
FIG. 12 is a chart showing the temperature of a wearer's foot over the course of several hours, as a result of the test set out in Example 2.

The conventional boot was compared to the ventilated boot using the same method as in Example 1, except that, rather than walking on a treadmill, the wearer conducted normal daily activities over the course of 6 hours with temperature measurements taken from inside each boot every hour. The results are show in FIG. 12.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A ventilation mechanism for a boot, comprising:

an intake reservoir positioned toward a heel section of a midsole;

an exhaust reservoir positioned near a toe section of the midsole and comprising a directional flow channel configured to facilitate air flow in a direction from the exhaust reservoir to an outside environment; and a connecting channel connecting the intake reservoir to the directional flow channel of the exhaust reservoir, the connecting channel being elongated along an entire length of the connecting channel and running longitudinally through a midfoot section of the midsole, wherein the directional flow channel comprises a main channel extending in a longitudinal direction and a plurality of angled conduits extending from longitudinal edges of the main channel, the plurality of angled conduits having a dead end configuration, wherein the connecting channel terminates at the main channel so that air flowing from the intake reservoir and exiting the connecting channel directly enters the main channel, wherein the main channel further comprises a first channel and a second channel, and wherein the plurality of angled conduits extend from opposed longitudinal edges of the first and second channels.

2. The ventilation mechanism of claim 1, wherein the directional flow channel is configured to inhibit air flow in a direction from the exhaust reservoir to the intake reservoir.

3. The ventilation mechanism of claim 1, wherein the plurality of angled conduits each have a length that is about 10% to about 40% a length of the main channel.

4. The ventilation mechanism of claim 1, wherein the directional flow channel provides about 65% to about 90% air flow by volume, based on a total volume of air flow into the intake reservoir, in a direction from the intake reservoir to the exhaust reservoir.

5. The ventilation mechanism of claim 1, wherein a volume of the intake reservoir is within a range of about 5 $cm^3$ to about 40 $cm^3$.

6. The ventilation mechanism of claim 1, wherein a volume of the exhaust reservoir is within a range of about 2.8 $cm^3$ to about 28 $cm^3$.

7. The ventilation mechanism of claim 1, wherein the connecting channel has a first width that is smaller than a second width of the intake reservoir and a third width of the exhaust reservoir.

8. The ventilation mechanism of claim 1 wherein the plurality of angled conduits comprise three or more angled conduits extending along a length of each of the first and second channels.

9. A ventilation mechanism for a boot, comprising:

an intake reservoir;

an exhaust reservoir comprising a directional flow channel configured to facilitate air flow in a direction from the exhaust reservoir to an outside environment, the exhaust reservoir having a top surface, a bottom surface, and a perforation extending through the top surface; and a connecting channel connecting the intake reservoir and the exhaust reservoir, wherein the directional flow channel comprises a main channel extending in a longitudinal direction and angled conduits extending from longitudinal edges of the main channel, and each of the angled conduits have a dead end configuration, wherein the connecting channel terminates at the main channel so that air flowing from the intake reservoir and exiting the connecting channel directly enters the main channel, and wherein the air entering the main channel is expelled out of the exhaust reservoir only through the perforation.

10. The ventilation mechanism of claim 9, wherein the perforation is positioned at an end of the directional flow channel.

11. The ventilation mechanism of claim 9, wherein three or more angled conduits extend along a length of the main channel.

12. The ventilation mechanism of claim 9, wherein the connecting channel is elongated along an entire length of the connecting channel.

* * * * *